United States Patent [19]

Pearson et al.

[11] 4,425,136

[45] Jan. 10, 1984

[54] MINIMALLY REFINED BIOMASS FUEL

[75] Inventors: Richard K. Pearson, Pleasanton; Tomas B. Hirschfeld, Livermore, both of Calif.

[73] Assignee: The United States of America as represented by the United States Department of Energy, Washington, D.C.

[21] Appl. No.: 247,709

[22] Filed: Mar. 26, 1981

[51] Int. Cl.[3] ..... C10L 1/32

[52] U.S. Cl. ..... 44/51; 44/53; 536/1; 536/1.1

[58] Field of Search ..... 44/51, 53, 77; 431/2, 431/4; 110/342, 346, 280; 536/1, 1.1

[56] References Cited

U.S. PATENT DOCUMENTS

| | | | |
|---|---|---|---|
| 1,504,837 | 8/1924 | Ricardo | 44/53 |
| 1,835,998 | 12/1931 | Giron | 44/51 |
| 2,603,557 | 7/1952 | Roush | 44/51 |
| 3,902,869 | 9/1975 | Friberg et al. | 44/51 |
| 4,067,748 | 1/1978 | Rowe | 536/1.1 |
| 4,083,698 | 4/1978 | Wenzel et al. | 44/51 |

OTHER PUBLICATIONS

Cotton, "Old Mr. Boston DeLuxe Official Bartender's Guide", 1963, pp. 2 and 13.

*Primary Examiner*—Charles F. Warren
*Assistant Examiner*—Y. Harris-Smith
*Attorney, Agent, or Firm*—Paul Davis; Harold M. Dixon; Richard G. Besha

[57] ABSTRACT

A minimally refined fluid composition, suitable as a fuel mixture and derived from biomass material, is comprised of one or more water-soluble carbohydrates such as sucrose, one or more alcohols having less than four carbons, and water. The carbohydrate provides the fuel source; water solubilizes the carbohydrates; and the alcohol aids in the combustion of the carbohydrate and reduces the vicosity of the carbohydrate/water solution. Because less energy is required to obtain the carbohydrate from the raw biomass than alcohol, an overall energy savings is realized compared to fuels employing alcohol as the primary fuel.

6 Claims, 2 Drawing Figures

MINIMALLY REFINED BIOMASS FUEL

The United States Government has rights in this invention pursuant to Contract W-7405-ENG-48 between the U.S. Department Energy and the University of California for the operation of Lawrence Livermore National Laboratory.

FIELD OF THE INVENTION

The invention relates to new compositions of matter useful as fuels, and more particularly to fuels derived from biomass; and still more particularly to fuels of the type employing a mixture of water-soluble carbohydrates and lower alkyl alcohols.

BACKGROUND OF THE INVENTION

With the occurrence of the current energy crisis, a shortage of liquid hydrocarbon fuels has been noted. Transportation is heavily dependent on liquid fossil fuels, as are home and industrial furnaces.

Fuels derived in whole or in part from biomass have recently become increasingly attractive. Biomass material has been transformed into methanol by pyrolysis and catalytic recombination, or ethanol by hydrolysis, fermentation, and distillation. The alcohol is then used as a blend with standard fuel in unmodified engines, or pure in engines which have been modified.

However, the large expenditure of energy generally deemed necessary to produce alcohol from raw biomass, and the inherent inefficiency of the typical fermentation process raises the question as to whether or not much energy is saved. Additionally, cost factors such as capital generally accepted as needed for processing plants and operating expenses of the fermentation and distillation plants may limit the economic savings of substituting alcohol for fossil fuel. It would be an advancement of the art to find a biomass-derived fuel which reduces the amount of "formation" energy that is typically required for producing alcohols. It would also be desirable if the fuel could be used with existing burners and transportation systems.

The present invention provides a fluid composition comprised of one or more water-soluble carbohydrates, one or more alcohols having less than four carbons, and water. This composition is essentially derived from biomass, and is superior to known biomass fuels because the amount of energy necessary to obtain water-soluble carbohydrates, or convert insoluble carbohydrates to soluble ones, is far less than that required for producing alcohols. For example, a sugar such as sucrose may be either directly obtained from biomass, or insoluble carbohydrates e.g., cellulose or starch, may be hydrolyzed to yield the sugar. In either case, the expenditure of energy is minimal. A simple alcohol (in limited concentration) would also be obtained from the biomass. The combination of water-soluble carbohydrates and alcohols requires less energy for its production than mere alcohol alone, and in the liquid phase the mixture is compatible with existing domestic and industrial furnaces. It is to be understood that alcohol may be produced from biomass by fermentation, or from coal or oil by synthesis for blending with carbohydrates in accordance with this invention. However, since the amount of alcohol produced would be less than in more conventional fuels where all the combustible component derived from biomass is alcohol, there would be an overall reduction in energy consumed in producing combustible fuel components from biomass in accordance with this invention.

Various fuel mixtures containing either carbohydrates, alcohols, or mixtures of both are known. In U.S. Pat. No. 1,527,144, issued to Frank E. Lichtenthaeler, a process for producing an alcohol-ether mixture directly from raw material containing sugars or starches and alcohol is disclosed. However, the final product does not contain a water-soluble carbohydrate such as a sugar. U.S. Pat. No. 3,393,059, issued to James E. Webb, with respect to an invention of James R. Mosler, discloses that honey may be added to a hydrocarbon fuel to control bacterial growth. Secondary effects of the honey include the trapping of dirt, water and other particulate matter entrained in the fuel; however, the specification fails to teach or suggest the inclusion of the honey as a fuel.

Gelled or semi-liquid fuel compositions comprising an alcohol, water, and a water-insoluble carbohydrate such as starch or cellulose serving as a gelling agent, are known. In U.S. Pat. No. 1,752,935, issued to Joseph A. Wyler, nitrostarch serves as the gelling agent for a solid and infusible alcohol fuel. In U.S. Pat. No. 1,995,911, issued to John Wysocki and William R. Rich, a fuel jelly is described which comprises an alcohol, water and a water-insoluble nitrocellulose solution. Finally, U.S. Pat. No. 2,613,142, issued to Sol B. Wiezer, discloses a fuel comprising alcohol, water and the gelling agent methyl cellulose.

However, none of the above teach or suggest that the proper combination of water-soluble carbohydrates such as sucrose, alcohols having less than four carbons, and water may be employed as a liquid fuel.

SUMMARY

It is an object of the invention to provide a fuel composition derived from biomass material which is only minimally refined.

Another object of the invention is to provide a fuel composition derived from biomass material in which the energy necessary to produce the components from the biomass is minimized.

A further object of the invention is to provide a fuel derived from biomass material which is in the liquid phase, and suitable for use in domestic and industrial burners.

Yet another object of the invention is to provide a fuel derived from biomass wherein the primary fuel component is one or more water-soluble carbohydrates.

Still another object of the invention is to provide a method for combusting in a furnace, employing a fuel mixture derived from biomass material wherein the primary feed is a water-soluble carbohydrate.

Additional objects, advantages, and novel features of the invention will be set forth in part in the description which follows, and in part will become apparent to those skilled in the art upon examination of the following, or will be learned by practice of the invention. The objects and advantages of the invention may be realized and attained by means of the instrumentalities and combinations particularly pointed out in the appended claims.

To achieve the foregoing and other objects, and in accordance with the purpose of the present invention, as embodied and broadly described herein, the fuel mixture may comprise a fluid (or liquid) composition of one or more alcohols having less than four carbons, water, and one or more water-soluble carbohydrates in an amount exceeding about 23% of the ratio of carbohydrate to water.

The present invention provides a liquid fuel mixture derived from biomass material which is only minimally refined. In the mixture, the water-soluble carbohydrate and the alcohol provide the fuel. Additionally, the alcohol serves to reduce viscosity. Because less energy is required to obtain a water-soluble carbohydrate than an alcohol from biomass, a savings in energy is realized. Additionally, because the refining is less extensive, a savings is realized in terms of economics.

DESCRIPTION OF THE DRAWINGS

The accompanying drawings, which are incorporated in and form a part of the specification, illustrate an embodiment of the present invention, and, together with the Description, serve to explain the principles of the invention. In the drawings.

DESCRIPTION

Figure 1:
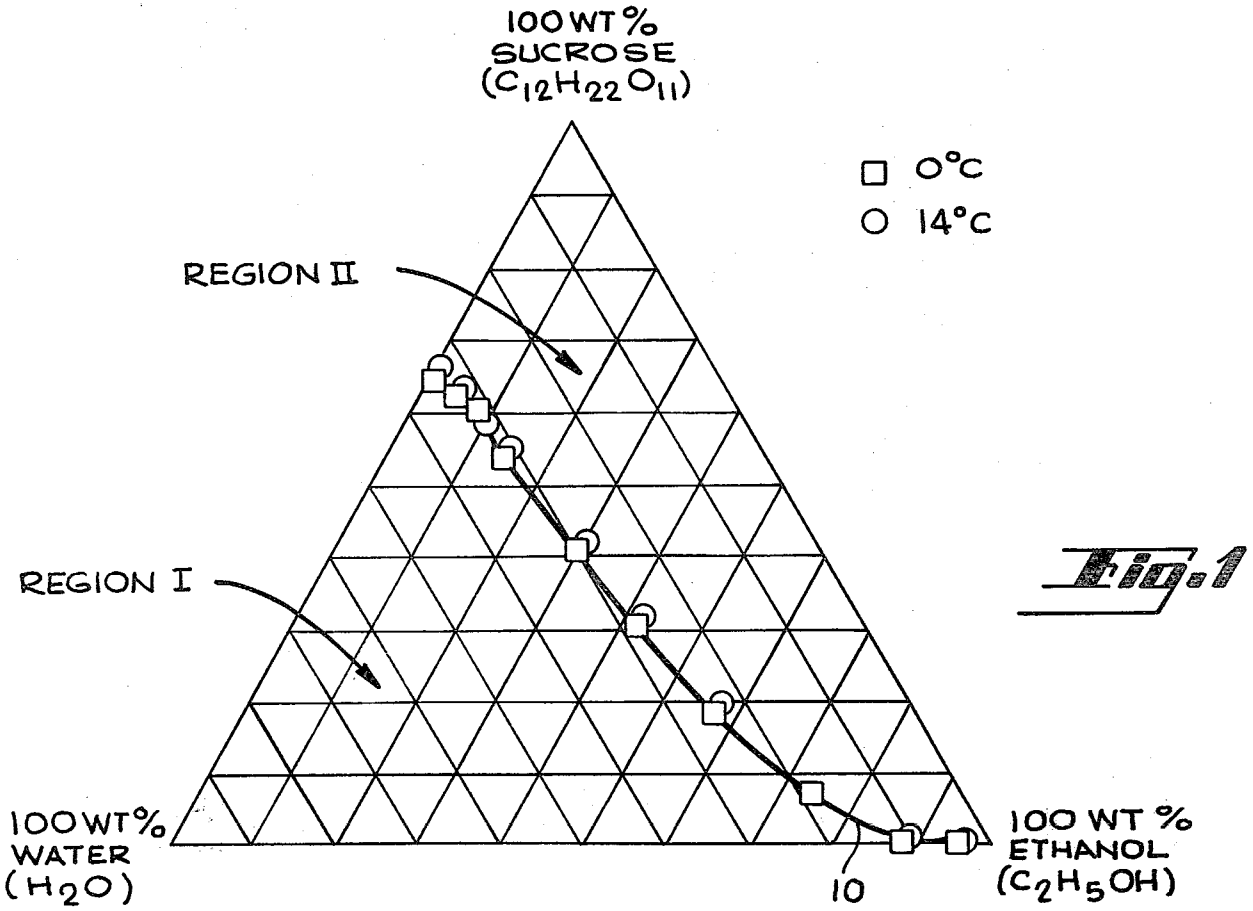
FIG. 1 represents a solubility phase diagram for sucrose, ethanol and water.

The present invention is the discovery that solutions of water-soluble carbohydrates, alcohols having less than four carbons, and water can be successfully employed as combustible fuel mixtures. The water-soluble carbohydrates provide the main energy source, the water permits the carbohydrates to exist as a liquid, and the alcohols promote burning of the carbohydrates and decrease the viscosity of the resulting carbohydrate/-water mixture. As used throughout this disclosure, carbohydrates are defined as compounds of carbon, hydrogen and oxygen containing the saccharose group:

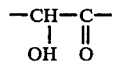

Of particular importance are those carbohydrates which are either water-soluble and directly derived from biomass material, or precursor cellulosics which are obtainable from biomass and subsequently hydrolyzed to yield water-soluble carbohydrates. Mixed carbohydrate solutions obtained as raw intermediates in the ethanol production process, such as the simple sugars, are excellent candidates. Monosaccharides having six carbons, and disaccharides having twelve carbons are the preferred sugars, while sucrose, and invert sugar, e.g., equal molar amounts of fructose and glucose, are the most preferred. Table I is an illustrative, non-exhaustive list of suitable sugars.

TABLE I

| Substance | Formula | Molecular Weight |
|---|---|---|
| β-d-Allose | $C_6H_{12}O_6$ | 180.16 |
| β-l-Allose | $C_6H_{12}O_6$ | 180.16 |
| β-d-Altrose | $C_6H_{12}O_6$ | 180.16 |
| β-l-Altrose | $C_6H_{12}O_6$ | 180.16 |
| β-d-Fructose | $C_6H_{12}O_6$ | 180.16 |
| α-l-Fucose | $C_6H_{12}O_5$ | 164.16 |
| α-d-Galactose | $C_6H_{12}O_6$ | 180.16 |
| β-d-Galactose | $C_6H_{12}O_6$ | 180.16 |
| α-d-α-Galaheptose, $H_2O$ | $C_7H_{14}O_7$ | 210.20 |
| β-d-β-Galaheptose | $C_7H_{14}O_7$ | 210.18 |
| β-d-α-Glucoheptose | $C_7H_{14}O_7$ | 210.18 |
| d-β-Glucoheptose | $C_7H_{14}O_7$ | 210.18 |
| α-d-Glucomethylose | $C_6H_{12}O_5$ | 164.16 |
| α-d-Glucose | $C_6H_{12}O_6$ | 180.16 |
| β-d-Glucose | $C_6H_{12}O_6$ | 180.16 |

TABLE I-continued

| Substance | Formula | Molecular Weight |
|---|---|---|
| α-d-α-Guloheptose | $C_7H_{14}O_7$ | 210.18 |
| α-d-β-Guloheptose | $C_7H_{14}O_7$ | 210.18 |
| α-Lactose, $H_2O$ | $C_{12}H_{24}O_{12}$ | 360.31 |
| β-Lactose | $C_{12}H_{22}O_{11}$ | 342.30 |
| α-d-Lyxose | $C_5H_{10}O_5$ | 150.13 |
| β-d-Lyxose | $C_5H_{10}O_5$ | 150.13 |
| β-Maltose, $H_2O$ | $C_{12}H_{22}O_{11}$ | 342.31 |
| α-d-α-Mannoheptose, $H_2O$ | $C_7H_{14}O_7$ | 210.20 |
| β-d-α-Mannoheptose, $H_2O$ | $C_7H_{14}O_7$ | 210.20 |
| α-d-β-Mannoheptose, $H_2O$ | $C_7H_{14}O_7$ | 210.20 |
| α-d-Mannose | $C_6H_{12}O_6$ | 180.16 |
| β-d-Mannose | $C_6H_{12}O_6$ | 180.16 |
| β-Melibiose, 2 $H_2O$ | $C_{12}H_{22}O_{11}$ | 342.33 |
| β-Neolactose | $C_{12}H_{22}O_{11}$ | 342.30 |
| α-l-Rhamnose, $H_2O$ | $C_6H_{12}O_5$ | 164.17 |
| β-l-Rhamnose | $C_6H_{12}O_5$ | 164.16 |
| d-Ribose | $C_5H_{10}O_5$ | 150.13 |
| l-Sorbose | $C_6H_{12}O_6$ | 180.16 |
| Sucrose | $C_{12}H_{22}O_{11}$ | 342.30 |
| α-d-Tabose | $C_6H_{12}O_6$ | 180.16 |
| β-d-Tabose | $C_6H_{12}O_6$ | 180.16 |
| α-d-Xylose | $C_5H_{10}O_5$ | 150.13 |

Other sugars can be successfully employed for purposes of the present invention.

The sugars disclosed herein, as well as other carbohydrates, may be obtained from the raw biomass material and used directly as fuel in an impure form, e.g., other biomass material such as amino acids and fatty acids, will also be included and combusted. However, standard methods well known in the art may be employed to obtain carbohydrates without these raw biomass impurities. For example, sucrose is obtained from sugar cane and sugar beets. To obtain sucrose from sugar cane, the cane is first crushed to squeeze out the sugar-bearing juice. The dark juice is then neutralized with lime, filtered, concentrated, crystallized, and centrifuged to produce raw sugar which averages more than 97% sucrose. Further refining produces the common white sugar which is 99.96% sucrose. Sucrose from sugar beets is obtained by counter-current extraction from beet slices.

It is known that a mixture of more than one sugar reduces the crystallization of a sugar solution, and increases the total concentration of the solubilized sugar. For this reason, it is particularly suitable for purposes of the present invention to include more than one sugar in the fuel mixture. Here the occurrence of invert sugar, a glucose-fructose mixture, produced in nature by the same plants that produce sucrose, or derivable from the latter by enzymatic or chemical hydrolysis, is important.

Although water-soluble sugars are the preferred carbohydrates, other non-soluble carbohydrates can be hydrolyzed to yield water-soluble products suitable as fuel components. Cellulose, the most abundant polysaccharide, constitutes approximately one-third the weight of annual plants and one-half the weight of perennial plants, and is made of β-D-glycopyranosyl units joined uniformly by (1→4)-links. However, cellulose is not water-soluble. Under acidic conditions (e.g., concentrated sulfuric acid treatment), the β-D-glycopyranosidic bonds are hydrolyzed to yield D-glucose, which is water-soluble.

It has been determined that, in a solution of carbohydrate and water, the carbohydrate concentration must be greater than 23% by weight in order to sustain combustion at 500° C. A temperature of 500° C. is necessary to prevent the formation of caramelized sugar on the interior furnace walls of an unmodified furnace. The minimum sugar concentration of 23% is determined as follows:

A carbohydrate solution, where the carbohydrate is represented as $(CH_2O)_x$, containing 1 g of carbohydrate and 4 g of water consumes on combustion 1.066 g of oxygen (in 5.088 g of atmosphere containing 4.022 g of other constituents). The combustion yields carbon dioxide and water as shown in the following equation, $$CH_2O+O_2 \rightarrow CO_2+H_2O$$

The reaction produces 1.466 g of $CO_2$, 4.022 g of other atmosphere constituents, e.g., $N_2$, and $0.50+\frac{7}{8}$g of $H_2$. Specific heats of the compounds are approximately as follows: 0.200 cal/g for $CO_2$; 0.240 cal/g for air; and 0.400 cal/g for steam. Thus the total heat capacity is $1.5+0.4_\chi$ cal. The heat of vaporization is (600 cal/g)(0.6)$+600_\chi$, and the heat of combustion is 3730 cal/gram of carbohydrate. At a temperature of 500° C., which is necessary to sustain complete burning without caramelization of the carbohydrate, then $$3750=360+600_\chi+(500)(1.5+0.4_\chi), \text{ and } \chi \text{ is } 3.3.$$

This is the minimum amount of water that can be present and still allow complete combustion of the 1.0 g of carbohydrate. The maximum allowable fraction of water is, therefore, $(3.3/3.3+1)=0.77$ or 77% water. Thus a solution containing at least 23% carbohydrate is necessary to sustain the 500° C. temperature. From an energy-saving perspective, the concentration of water-soluble carbohydrate must be maximized, and yet the carbohydrate should not crystallize out of solution. Thus although a minimum of 23% carbohydrate to water is necessary, the actual concentration will be much higher, as shown in the examples disclosed herein. Because the major fuel source in the mixture is carbohydrate, its concentration is maximized without permitting crystallization.

Alcohol choice is dependent on the following factors: solubility in water, compatibility with the water-soluble carbohydrate, source, and cost. Although alcohols having four or less carbon atoms are water-soluble, it has been determined that alcohols with four carbons tend to reduce the solubility of the carbohydrate in water. Thus, the preferred alcohols for purposes of the present invention are n-propanol, isopropanol, ethanol, and methanol. Because ethanol and methanol are readily obtainable from biomass, they are the most preferred. An alcohol concentration from about 19 to 30% by weight of the total fuel mixture is employed.

Although the fuel composition of water-soluble carbohydrate, alcohol and water burns well, a surfactant may also be added to the mixture for the purpose of decreasing surface tension and hence promote the formation of smaller sized fuel droplets. This aids the burning process. The particular chemistry of the surfactant is not crucial. An example of a suitable surfactant is a polyoxyethylene derivative of fatty acid partial esters of hexitol anhydride, marketed as "Tween-20" by Atlas Power Company of Wilmington, Del. A concentration of about 0.1% by weight of the total fuel mixture has been found to work well.

FIG. 1 is a phase diagram of the mixture sucrose, ethanol and water. As shown, the squares along line 10 represent solubility at 0° C., and the circles illustrate the solubility at 14° C. The area within Region I is the single phase region where the mixture exists only as a liquid. Region II is the two-phase liquid/solid region. The two regions are separated by line 10. Of particular importance for purposes of the present invention is the single liquid phase. As previously noted in this disclosure, a carbohydrate/water fraction greater than about 23% is necessary to sustain combustion at 500° C. Thus, those fuel compositions found within Region I having a carbohydrate/water fraction greater than 23% are suitable fuel mixtures. Although carbohydrate is less energy-intensive than alcohol, and its concentration should be maximized, the relative concentrations of carbohydrate and alcohol can be varied. However, it is desirable to substitute as much carbohydrate for alcohol as possible. Thus, from an energy-saving standpoint, the most optimal fuel mixtures will be found within Region I, closest to line 10, without the carbohydrate crystallizing out of solution. Because it is contemplated that the fuel mixture of the present invention will be in the liquid phase, fuel mixtures within Region I will be suitable for use in home and industrial furnaces.

Figure 2:
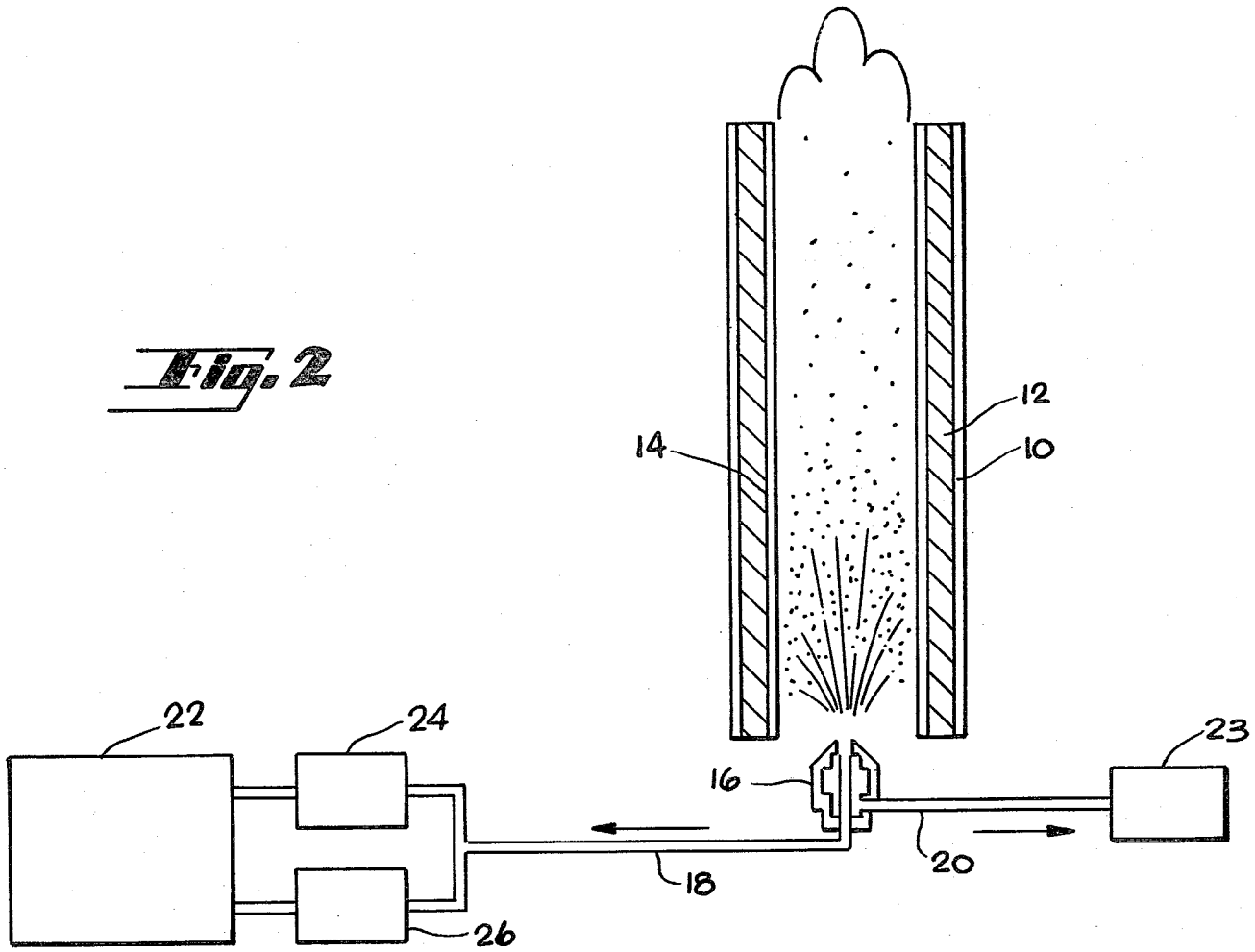
FIG. 2 is a schematic diagram of a domestic burner test apparatus.

FIG. 2 illustrates a domestic burner test apparatus. A layer of insulation 12 is disposed within double-walled furnace body 10 which is made of stainless steel. A thermocouple 14 is affixed to the interior wall of the furnace body. At the base of furnace body 10 is a nozzle assembly 16, obtained from a Koehring Reddy heater, which is connected to pump line 18 and air supply line 20. Pump line 18 is in turn connected to an infusion withdrawal pump 22 made by Harvard Apparatus Co. Air supply 20 is connected to an air source 23 which may comprise air or pure oxygen, and introduces air/oxygen to the furnace at an adjustable rate. Pump line 18 is connected to a syringe 24 of fuel mixture and a syringe 26 of alcohol, e.g., ethanol.

In operation, ethanol from syringe 26 is pumped through line 18 and injected into the furnace as it exits nozzle assembly 16. Simultaneously, air or oxygen is supplied to nozzle assembly 16 and also introduced. As the ethanol burns, the temperature of the interior wall of furnace body 10 rises. When the temperature reaches approximately 500° C., fuel mixture from syringe 24 is pumped and introduced into the furnace while the pumping of ethanol from syringe 26 ceases. It is necessary to first burn the ethanol in order to raise the temperature of the interior furnace wall. At lower temperatures, as previously noted, certain carbohydrates such as sucrose tend to caramelize on the furnace walls without burning the caramelized sugar from the walls, and complete burning of the fuel mixture is not achieved. However, once a temperature of about 500° C. is reached, the fuel mixture can burn completely and unaided for an indeterminate length of time without caramelization occurring on the interior furnace walls.

If the interior furnace wall temperature could initially be at the elevated temperature of 500° C., it would not be necessary to burn the ethanol/water mixture, and syringe 26 could be eliminated. Alternatively, the interior furnace walls could be coated with a cerium-based catalyzer much like the one applied to self-cleaning oven walls. This would lower the temperature necessary to prevent caramelization to about 200° C.

The present invention may be used as an alternate or extender fuel in small stationary furnaces such as home furnaces. It is postulated that it could also be used as a blend with diesel fuels to power diesel engines if appropriate modifications of the engine are made.

The following examples are illustrative of the present invention, and are not to be regarded as limitative. It is to be understood that all parts, percentages and proportions referred to herein and in the appended claims are by weight unless otherwise indicated.

EXAMPLE 1

A fuel mixture of 49% sucrose, 19% ethanol (200-proof), and 32% water was prepared. 0.1% of the commercially available surfactant "Tween-20" was added to lower the surface tension of the fuel mixture and enable the formation of smaller droplets from the nozzle. The apparatus described above and illustrated in FIG. 2 was employed with the liquid flow rate adjusted to 12.0 ml/min. and the air flow rate approximately 10 l/m. Before the fuel mixture was burned, the interior wall of the furnace body was raised to 500° C. by burning a 70% ethanol solution. Once this temperature was reached, 35 ml of the fuel mixture was burned, sustaining a flame about ten inches long. 1.19 g of caramelized sugar was collected on a clean glass dish positioned above the furnace, and 0.08 g collected from the interior of the furnace, indicating that 93.7% of the sucrose in the fuel mixture was burned. The temperature of the interior of the furnace at the conclusion of the fuel mixture-burning was 570° C.

EXAMPLE 2

A fuel mixture of invert sugar, ethanol and water was burned. The mixture was comprised of 25.8% glucose, 25.8% fructose, 19.0% ethanol, and 29.4% water. Again, the apparatus of FIG. 2 was employed, with the liquid flow rate adjusted to 15.3 ml/min and the air flow rate approximately 11 l/m. A 70% ethanol solution was initially burned, bringing the interior wall temperature of the furnace to 550° C. 25 ml of the fuel mixture was then burned, with 0.82 g of caramelized sugar collected, indicating that 95.1% of the glucose and fructose burned.

EXAMPLE 3

A fuel mixture of 40% sucrose, 30% methanol, and 30% water was burned using the apparatus shown in FIG. 2, with the air flow rate adjusted to approximately 11 lm, and liquid flow rate 15.3 ml/min. A 70% ethanol solution was burned until the furnace body interior wall reached 560° C. 45 ml of the fuel mixture was then burned, sustaining a flame and temperature at 545° to 555° C. No caramelization was observed.

The foregoing description of a preferred embodiment of the invention has been presented for purposes of illustration and description. It is not intended to be exhaustive or to limit the invention to the form disclosed, and obviously many modifications and variations are possible in light of the above teaching. The embodiments were chosen and described in order to best explain the principles of the invention and its practical application, to thereby enable others skilled in the art to best utilize the invention in various embodiments, and with various modifications as are suited to the particular use contemplated. It is intended that the scope of the invention be defined by the claims appended hereto.

We claim:

1. A combustible furnace fuel, comprising:

a mixture of alcohols, each of said alcohols having less than 4 carbon atoms, said alcohols being present in an amount from about 19 to 30 percent of the total weight of said fuel;

water; and a mixture of water soluble carbohydrates containing the sacrose group

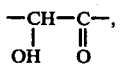

$$-\underset{\underset{OH}{|}}{CH}-\underset{\underset{O}{\|}}{C}-,$$

said carbohydrates being present in an amount which exceeds about 23 percent by weight relative to water.

2. The combustible furnace fuel according to claim 1, additionally comprising a surfactant to lower surface tension of said furnace fuel.

3. The combustible furnace fuel according to claim 2, wherein said surfactant is present in an amount of about 0.19 percent of the total weight of said furnace fuel.

4. The combustible furnace fuel according to claim 1, wherein said carbohydrate mixture comprises a mixture of sugars selected from fructose, glucose and sucrose.

5. The combustible furnace fuel according to claim 1, wherein said carbohydrate mixture comprises glucose and fructose.

6. The combustible furnace fuel according to claim 1, wherein said carbohydrate mixture comprises an equal molar mixture of glucose and fructose in an amount not exceeding about 51.6 percent of the total weight of said furnace fuel.

* * * * *